United States Patent [19]

Jensen et al.

[11] Patent Number: 4,465,437

[45] Date of Patent: Aug. 14, 1984

[54] PUMP COMPRISING A CANNED MOTOR

[75] Inventors: Niels Jensen; Kurt F. Nielsen, both of Bjerringbro, Denmark

[73] Assignee: Grundfos A/S, Bjerringbro, Denmark

[21] Appl. No.: 345,569

[22] Filed: Feb. 4, 1982

[30] Foreign Application Priority Data

Feb. 14, 1981 [DE] Fed. Rep. of Germany ..... 3105389

[51] Int. Cl.[3] ..... F04B 39/02; F04B 35/04

[52] U.S. Cl. ..... 417/366; 417/423 R

[58] Field of Search ..... 417/372, 423 R, 902, 417/366, 435

[56] References Cited

U.S. PATENT DOCUMENTS

| | | | |
|---|---|---|---|
| 2,928,585 | 3/1960 | Keep et al. | 417/435 |
| 2,939,399 | 6/1960 | Rutschi | 417/423 R |
| 3,288,073 | 11/1966 | Pezzillo | 310/86 |
| 3,395,644 | 8/1968 | Grebel et al. | 417/357 |
| 4,251,190 | 2/1981 | Brown et al. | 417/68 |

FOREIGN PATENT DOCUMENTS

| | | | |
|---|---|---|---|
| 1100787 | 3/1961 | Fed. Rep. of Germany | 417/366 |
| 1901306 | 9/1964 | Fed. Rep. of Germany . | |
| 2044295 | 3/1972 | Fed. Rep. of Germany | 417/372 |
| 2516575 | 10/1976 | Fed. Rep. of Germany | 417/366 |
| 2529399 | 1/1977 | Fed. Rep. of Germany | 417/366 |
| 2639541 | 3/1978 | Fed. Rep. of Germany | 417/423 R |
| 2712155 | 9/1978 | Fed. Rep. of Germany | 415/112 |
| 2398435 | 2/1979 | France . | |
| 922958 | 4/1963 | United Kingdom | 417/423 R |
| 925881 | 5/1963 | United Kingdom | 417/366 |
| 974201 | 11/1964 | United Kingdom | 417/423 R |
| 1033601 | 6/1966 | United Kingdom | 417/366 |
| 2029649 | 3/1980 | United Kingdom | 417/366 |

*Primary Examiner*—William L. Freeh
*Assistant Examiner*—Paul F. Neils
*Attorney, Agent, or Firm*—Michael N. Meller

[57] ABSTRACT

In a pump comprising a slotted tube motor, the ventilating procedure is carried out by the water entering a rotor chamber and being caused to circulate by means of the rotating rotor in such a manner that a circulating ring of liquid is formed within the rotor chamber, and that the air present in the chamber is pressed towards the axis of rotation of the rotor. The liquid flows from a pump room into the rotor chamber through a bearing slot in a front sliding bearing situated at the impeller of the pump. Liquid from the ring of liquid adjacent the rear sliding bearing is carried into a bearing slot in the rear sliding bearing by way of a connecting duct formed in part in the bearing sleeve. This sliding bearing opposes an air duct closed by a vent plug. The rotor chamber and the air duct are interconnected solely through the bearing slot in the rear sliding bearing.

4 Claims, 2 Drawing Figures

PUMP COMPRISING A CANNED MOTOR

FIELD OF THE INVENTION

The invention relates to a pump comprising a canned motor. The pump shaft is mounted in two sliding bearings situated on each side of a rotor stack of sheets and is lubricated by the pumped water. The water entering the rotor chamber through the bearing slot in the front sliding bearing (adjacent the impeller of the pump) is so intensely stirred when the rotor rotates that a circulating ring of liquid is formed, whereas the air f the rear sliding bearing, it is, however, necessary to take particular measures since no or only a small amount of water is available for this bearing slot, at least during the ventilation.

The static and optionally also the dynamic pressures within the ring of water rotating in the rotor chamber are therefore utilized, since water from this ring is drained off through a stationary distributor. The water thus drained off is then carried through a duct to the outer end of the bearing slot, i.e. to the end of the bearing slot facing away from the rotor, and from this point the water flows through the bearing slot into the air-filled space along the axis of rotation or at the shaft surface. As a result, the water gradually presses the air out into the pump room through an air duct formed in the shaft. However, this flow only exists as long as the pressure within the water entering the rotor chamber through the bearing slot is sufficiently high.

Certain constructive circumstances imply, however, that such water pressure cannot always be provided, at least not for a period sufficient for providing a complete ventilation of the rotor chamber. German patent specification No. 1,100,787 and British patent specification No. 2,029,649, which are mentioned as examples, disclose structural solutions to this problem whereby the rear sliding bearing usually is provided with sufficient water, but as a result of which it is not possible to pass air to the ambiency for the purpose of quick ventilation, by removing the the vent plug thereby opening the air duct without entailing great losses of water from the rotor chamber.

SUMMARY OF THE INVENTION

The object of the invention is to overcome this drawback. A particular object of the invention is to provide a more reliable supply of lubricating water to the rear sliding bearing in such a manner that quick ventilation is not accompanied by an unnecessarily or unreasonably great loss of water from the rotor chamber, this water primarily entering the rotor chamber by means of the system pressure.

The pump provided with a canned motor is according to the invention characterized in that the rotor chamber and the air duct are interconnected solely by means of the bearing slot of the rear sliding bearing.

According to the invention, the connecting duct may open directly into the bearing slot of the rear sliding bearing or at that end of the bearing slot which faces the rotor chamber, whereas the outer end of the bearing slot and the air duct are closed by means of a sealing member. Furthermore, a duct opening in the bearing slot of the rear sliding bearing may be located in such a manner that its distance to the inner end of the bearing slot is greater than its distance to the outer end of the bearing slot.

Furthermore, according to the invention the bearing sleeve of the rear sliding bearing may comprise a passage duct extending from the outer defining surface of the sleeve to the load-bearing surface, whereby the opening of the passage duct situated on the smallest radius forms the opening of the previously mentioned connecting duct, such that the ratio of the axial distance 1 between this opening and the outer end of the bearing slot to the axial length L of the bearing sleeve is in the range $0.1 \leqq 1/L \leqq 0.5$. Moreover, the bearing sleeve may comprise a groove extending along its entire circumference, the passage duct extending from the bottom of this groove to the bearing slot previously mentioned opening.

In order to avoid misunderstandings, it should here be mentioned that the "inner" end of the bearing slot rear sliding bearing is directed "inwards" towards the rotor chamber, whereas the "outer" end of this bearing slot is directed "outwards", i.e. is situated opposite the air duct, which is closed by a plug when the pump is running.

Since neither the connecting duct nor the rotor chamber are directly connected with the outer end of the bearing slot and the air duct, and since the air duct is closed for passage of water from the rotor chamber, the water can only reach the ambiency when the air duct is open by flowing from the rotor chamber or the connecting duct through the bearing slot during simultaneous lubrication of the rear sliding bearing.

Since the atmospheric pressure during this procedure is lower than the air pressure within the rotor chamber, only a small amount of water escapes during a quick ventilation of air out into the ambiency through the bearing slot, whereas the rotor chamber now containing no air simultaneously is filled with a relatively great amount of water which flows through the bearing slot of the front sliding bearing and a duct formed in the shaft, this duct communicating with the pump room.

When the air duct is closed, air may flow from the rotor chamber through the duct of the rotor shaft and directly into the pump room. Such a solution has been illustrated and described for instance in German Laid-Open Pat. No. 2,516,575.

BRIEF DESCRIPTION OF THE DRAWINGS

The invention will be described below with reference to the accompanying drawings, in which.

DESCRIPTION OF THE PREFERRED EMBODIMENTS

Figure 2:
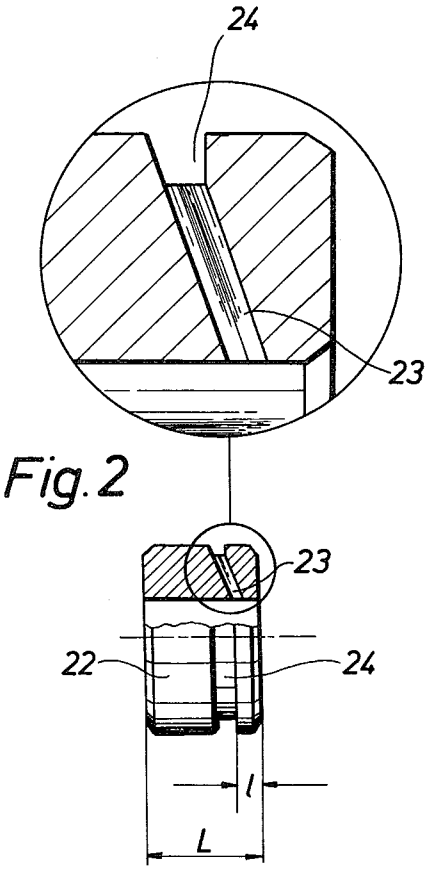
FIG. 2 is a partially sectioned view of a bearing sleeve forming part of the canned motor of FIG. 1, in which part of the bearing sleeve has been removed and part of the bearing sleeve is illustrated on a very large scale within a circle.

The pump comprises an impeller 1 carried by a pump shaft 2. The latter is supported by two sliding bearings situated on their respective side of a rotor stack of sheets. The front sliding bearing is provided with a bearing sleeve 4, and the rear sliding bearing is provided with a bearing sleeve 5. In the present embodiment, the bearing sleeves 4 and 5 are made of ceramics, as is the pump shaft 2 at least in its bearing portions, whereby ceramics bear against ceramics during the running of the pump.

The motor comprises a rotor chamber 6 separated from the pump room 7 of the pump by means of a partition 8 and separated from the stator chamber 9 of the motor by means of a tube-shaped can 10. The windings 11 of the motor and a stator stack of sheets 12 are present in stator chamber 9.

Opposite the rear sliding bearing and on the same shaft as said sliding bearing, is a vent plug 13, is present which comprises a threaded piece pressed through a central hole in the bottom 10*a* of can 10. In the present embodiment vent plug 13 is screwed into the threaded opening 14*a* in a sealing member 14, this threaded opening forming the air duct. This sealing member is, as illustrated, substantially annular and clamped between the bottom 10*a* of the can and one end surface of the bearing sleeve 5.

When the rotor chamber 6 is not completely ventilated, water penetrates from the pump room 7 into the rotor chamber through a bearing slot 4*a* in the front sliding bearing and is caused to rotate 3 by means of the rotating rotor. The resulting centrifugal field produces a ring of liquid on the inner surface of the can 10, while air is pressed inwardly towards the axis of the rotor chamber, from which the air is to be subsequently removed.

The liquid circulating at the bearing sleeve 5 is carried further on through a stationary distributor. In the illustrated embodiment, this distributor comprises a connecting duct. This connecting duct comprises (see FIG. 1) a first duct portion 15 extending radially inwards from the outside and towards to the sealing member 14, and then follows a second duct portion 16 which extends axially and is situated on the outer surface of the bearing sleeve 5. Finally, a third duct portion 17 extends radially inwards to the inner end 18 of the bearing slot 5*a*.

This duct comprises in principle several parts and portions, and along its way to its opening at the inner end 18 of the bearing slot 5*a* it is defined by the walls of the can bottom 10*a*, the bearing sleeve carrier 19, the sealing member 14, and the bearing sleeve 5. Besides, the sealing member 14 closes the outer end 20 of the bearing slot 5*a* so that no escape of water or and possible air from the rotor chamber 6 or said connecting duct 15, 16, 17 is possible.

When the vent plug 13 is removed for a quick ventilation of the rotor chamber 6, both air and water flow, from as a result of rotation, along the duct and the bearing slot 5*a* and then through the air duct 14*a*, which is now open. As mentioned above, the amount of water and air flowing through the bearing slot 5*a* is, however, smaller than the amount of water flowing into the rotor chamber 6 through the bearing slot 4*a* and the duct 21 (indicated by a dotted line) as a consequence of a drop in pressure between the pump room 7 and the rotor chamber 6. Therefore, in a very short time the rotor chamber is ventilated, and the air duct can then be reclosed by means of the plug 13.

Even if the vent plug is not removed in order to obtain a quick ventilation, it is still possible to obtain an appropriate ventilation of the rotor chamber as well as a sufficient lubrication of the rear bearing slot 5*a*. The water is carried through the connecting duct 15, 16, 17 to the inner end 18 of the bearing slot 5*a* and partly by means of a capillary effect some water passes through the bearing slot while most of the water returns to the rotor chamber, viz. through the annular slot between the curved surface of the shaft and the inner end of the bearing sleeve carrier 19. The remaining procedures and conditions to be observed in order to obtain only automatic ventilation are quite well-known, for which reason they are not described in detail here. In this connection, reference is made to the subject matter of German Laid-Open patent application No. 516,575.

Figure 1:
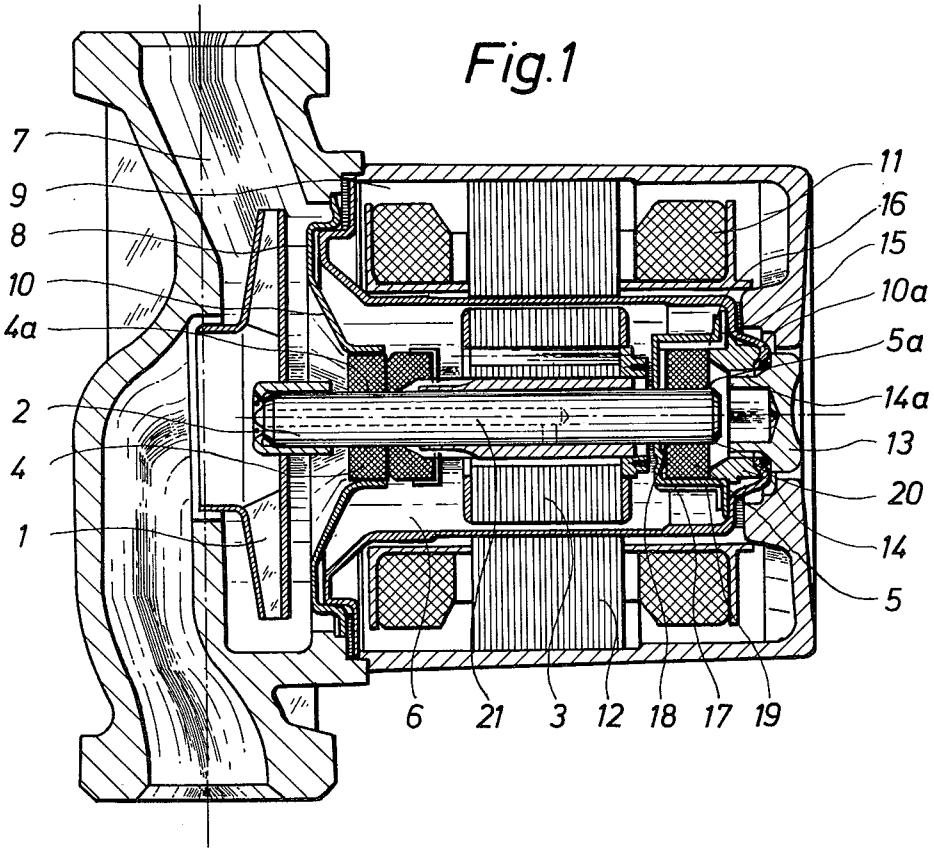
FIG. 1 is a longitudinal, sectional view of a pump according to the invention and provided with a canned motor.

Instead of the bearing sleeve 5 illustrated in FIG. 1, it is possible to use a bearing sleeve 22 as illustrated in FIG. 2. This bearing sleeve has a passage duct 23 extending from the outer circumferential surface of the bearing sleeve 22 to the bearing surface of the bearing sleeve. In this embodiment, the water-carrying duct comprises the duct portion 15 and part of portion 16 as depicted in FIG. 1, the latter duct portion, however, being directly connected to the passage duct 23 at the outer surface of the bearing sleeve. The inner end of this duct 23 (i.e. closest to pump shaft 2) forms the opening in the duct complex. In this embodiment this means that the water-carrying duct opens directly into the bearing bore of the rear sliding bearing.

The above duct opening is not equally spaced from the ends 18 and 20 of the bearing slot 5*a*. Its distance 1 to the outer end 20 is smaller than its distance to the inner end 18, whereby a forced lubrication of the largest portions of the load-bearing surface is produced when the air duct defined by opening 14*a* is closed. During the ventilation procedure when the duct air duct is open, only a small parts of the load-bearing surface is lubricated. However, since the ventilation only lasts a few minutes, the risk of damage to the bearing is considerably smaller at running with a closed air duct 14*a*. The ratio of the axial distance 1 between the opening and the outer end 20 of bearing slot 5*a* to the axial length L of the bearing sleeve 22 can be in the range $0.1 \leqq 1/L \leqq 0.5$.

The bearing sleeve 22 circumferential groove on its outer surface, the passage duct 23 extending from the bottom of this groove to the bearing slot 5*a*. The groove 24 ensures that an appropriate amount of water is always supplied through the passage duct 23 to the load-bearing surface.

When using the structural solution illustrated in FIG. 2, duct portion 17 and part of duct portion 16 of FIG. 1 may be omitted. When water is to be carried both directly into the bearing slot 5*a* and to the inner end 18 of the bearing slot, the bearing sleeve 5 must be replaced by the bearing sleeve 22. The remaining parts may be maintained unchanged.

We claim:

1. A pump having a slotted tube motor, comprising:

(a) a housing having a partition for defining a pump chamber and a motor chamber;

(b) a can arranged in said housing for defining a rotor chamber and a stator chamber in said motor chamber, said can having a tubular wall and a bottom wall in which an opening is defined;

(c) a pump shaft arranged in said pump and rotor chambers;

(d) a rotor arranged in said rotor chamber and rigidly fixed to an intermediate portion of said pump shaft;

(e) first and second bearing sleeves in which said pump shaft is rotatably mounted, said first bearing sleeve being arranged between said partition and said rotor, and said second bearing sleeve being arranged between said rotor and said opening in said bottom wall of said can;

(f) an annular sealing means arranged between said second bearing sleeve and said bottom wall of said can, said sealing means defining an air duct;

(g) a vent plug removably arranged in interlocking relationship with said sealing means whereby said air duct is closed; and (h) a connecting duct having an inlet adjacent to said bottom wall of said can and having an outlet connected at a point along a slot defined between said second bearing sleeve and said pump shaft, wherein in response to rotation of said pump shaft, a liquid medium is forced away from and a gaseous medium is forced toward said pump shaft, and wherein said connecting duct is arranged such that, in response to the opening of said air duct, said media pass from said rotor chamber to said open air duct by way of said slot exclusively, except that said liquid medium reaches said slot by way of said connecting duct, as a result of which said gaseous medium is ventilated and said liquid medium lubricates said slot, and wherein said gaseous medium is not ventilated when said air duct is closed.

2. A pump as claimed in claim 1, wherein a portion of said connecting duct is formed by a passage duct in said second bearing sleeve, said passage duct having an inlet on the outer circumferential surface of said second bearing sleeve and having an outlet on the load-bearing bore surface of said second bearing sleeve.

3. A pump as claimed in claim 2, wherein said slot of said second bearing sleeve has an axial length L, said outlet of said passage duct is located an axial distance 1 from the end of said slot remote from said rotor, and the ratio 1/L is in the range $0.1 \leqq 1/L \leqq 0.5$.

4. A pump as claimed in claim 3, wherein said second bearing sleeve has a circumferential groove on said outer circumferential surface, said inlet of said passage duct being located in the bottom of said groove.

* * * * *